United States Patent [19]

Fujii

[11] Patent Number: 4,705,579

[45] Date of Patent: Nov. 10, 1987

[54] METHOD FOR COOLING A METAL STRIP IN A CONTINUOUS ANNEALING FURNACE

[75] Inventor: Taisuke Fujii, Kitakyushu, Japan

[73] Assignee: Nippon Steel Corporation, Tokyo, Japan

[21] Appl. No.: 827,488

[22] Filed: Feb. 6, 1986

Related U.S. Application Data

[63] Continuation of Ser. No. 574,349, Jan. 27, 1984, abandoned.

[30] Foreign Application Priority Data

Feb. 3, 1983 [JP] Japan ..... 58-15521

[51] Int. Cl.[4] ..... C21D 1/78

[52] U.S. Cl. ..... 148/142; 148/156

[58] Field of Search ..... 266/109, 111–113; 148/153, 142, 155, 156; 165/90

[56] References Cited

U.S. PATENT DOCUMENTS

| | | | |
|---|---|---|---|
| 3,169,050 | 2/1965 | Kroon | 165/90 |
| 3,725,994 | 4/1973 | Wechsler | 29/447 |
| 4,071,081 | 1/1978 | Chielens et al. | 165/82 |
| 4,377,335 | 3/1983 | Fannon et al. | 355/3 FU |

FOREIGN PATENT DOCUMENTS

| | | | |
|---|---|---|---|
| 54-118315 | 9/1979 | Japan . | |
| 14444 | 1/1982 | Japan . | |
| 57-23036 | 2/1982 | Japan . | |
| 23037 | 2/1982 | Japan | 266/109 |
| 107422 | 6/1983 | Japan | 266/109 |

*Primary Examiner*—Christopher W. Brody
*Attorney, Agent, or Firm*—Kenyon & Kenyon

[57] ABSTRACT

The present invention relates to a method and apparatus for cooling a steel strip in a continuous annealing furnace, wherein the steel strip is continuously conveyed through a heating zone, a soaking zone, and, occasionally, an overaging zone and a secondary cooling zone, and cooling of the steel strip is carried out by roll-cooling, in which the steel strip is brought into contact with and is turned around a rotatable roll which is continuously cooled by a cooling medium. The present invention is characterized in that a roll comprising a roll shaft (12) and a shrinkage-fitted roll sheath (11) fixed to the roll shaft (12) is used for roll-cooling and, further, in that the cooling medium is circulated around the roll shaft through a cooling medium-circulating passage (15) which is formed on at least the inner surface of said roll sheath or the outer surface of said roll shaft (12) or both, and is then withdrawn from the roll shaft (12). The cooling uniformity of a steel strip (1) as seen in the short width direction is improved by the present invention.

7 Claims, 11 Drawing Figures

METHOD FOR COOLING A METAL STRIP IN A CONTINUOUS ANNEALING FURNACE

This application is a continuation, of application Ser. No. 574,349, filed Jan. 27, 1984 now abandoned.

BACKGROUND OF THE INVENTION

1. Field of the Invention

The present invention relates to a method and an apparatus for cooling a metal strip in a continuous annealing furnace. More particularly, the present invention relates to a cooling method and apparatus in which a metal strip which is heated in a continuous annealing furnace is cooled by bringing it into contact with a cooled roll, the metal strip being uniformly cooled by this method and apparatus at a predetermined cooling rate as seen in the short width direction thereof.

2. Description of the Prior Art

Due to recently developed techniques for producing cold-rolled steel strips, strips exhibiting good drawability and formability can be produced by continuous annealing rather than batch annealing. Since the continuous annealing techniques enable a higher productivity and a greater cost reduction than do the batch annealing techniques, the continuous annealing techniques have been more broadly used heretofore.

Representative heat cycles, to which a steel strip is subjected in a continuous annealing furnace, are explained with reference to FIGS. 1 and 2.

In FIG. 1, the so-called stop quenching heat cycle is illustrated. In the primary cooling step, gas-jet cooling, in which a cooling gas is directly blown onto the heated steel strip, is carried out. In FIG. 2, the so-called full quenching heat cycle is illustrated. In the primary cooling step, the heated steel strip is cooled by spraying it with water and then immersing it in water.

The above-described cooling methods are disadvantageous in the following respects:

(1) By gas-jet cooling, it is difficult to attain a high cooling rate of approximately 100° C./second.

(2) Water-cooling can provide a high cooling rate but cannot realize an end-point control; thus, the steel strip is inevitably cooled to normal temperature. The steel strip must, therefore, be reheated up to a temperature at which overaging is carried out. In addition, since the surface of the steel strip is oxidized, a treatment such as pickling becomes necessary and, thus, the installation and operation costs become high.

As one method by which the above-described disadvantages can be eliminated, a roll-cooling method is proposed. In the roll-cooling method, a heated steel strip to which a predetermined tension is applied is engaged with and is turned around a rotatable roll which is continuously cooled by a cooling medium. The known roll-cooling methods cannot attain uniform cooling of a steel strip as seen in the short width direction for the following reasons.

The roll body of a cooling roll is monolithic and has such a length that a steel strip is brought into contact with a central portion of the roll body as seen in its axial direction. The temperature of this central portion is higher than the non-contact portion, with the result that a heat crown is formed on the roll body and, thus, contact between the steel strip and the roll body is impeded at both edges of the steel strip. Both edges of the steel strip are, therefore, not cooled, and a nonuniform temperature distribution is generated along the short width direction of the steel strip. The cooled central portion of the steel strip shrinks thermally, with the result that a nonuniform tension, i.e., a high tension at the cooled central portion and a low tension at the non-cooled edges, is generated in the steel strip. Due to this nonuniform tension distribution, the cooled portion of the steel strip having a high tension is further brought into close contact with the cooling roll, and contact between the non-cooled portions (both edges) having a low tension with respect to the cooling roll is further impeded. As a result, the nonuniform temperature distribution along the short width direction of the steel strip, i.e. a direction traversal to the strip conveying direction, is intensified.

Japanese Unexamined Patent Publication No. 57-23036 proposes the use of a cooling medium capable of being used at a higher temperature than the water and thus decreasing the temperature difference between the cooling roll and the steel strip, thereby attempting to lessen the nonuniform temperature distribution as seen in the axial direction of the roll body. However, according to this proposal, the cooling efficiency in terms of the cooling rate of a steel strip becomes considerably less than that attained by the roll-cooling method in which water is used. In addition, according to this proposal, effective reduction of the heat crown is not provided.

Japanese Unexamined Patent Publication No. 54-118315 proposes the formation of, in the roll body of a cooling roll, cooling medium passages which are separated from each other as seen in the axial direction of the roll body. It also proposes separate control of the cooling medium temperature and the flow rate in each cooling medium passage. In the cooling method proposed in this publication, it is difficult to optionally reduce the cooling rate in a selected cooling medium passage(s) since bumping must be prevented. Therefore, the heat crown cannot be reduced to a satisfactorily low level.

According to the proposals of the above two publications, the structure of the cooling roll becomes complicated, and the controlling device becomes largesized and uneconomical.

SUMMARY OF THE INVENTION

It is an object of the present invention to remove the disadvantages of the known roll-cooling methods for cooling a steel strip in a continuous annealing furnace by a method in which a heated steel strip which is subjected to a predetermined tension is engaged with and is turned around a continuously cooled cooling roll, thereby easily and economically suppressing the heat crown, which is a major factor causing nonuniform cooling of a steel strip as seen in its short width direction.

It is another object of the present invention to provide an apparatus for cooling a steel strip in a continuous annealing furnace, the apparatus removing the disadvantages of the known cooling rolls.

In accordance with the objects of the present invention, there is provided a method for cooling a steel strip in a continuous annealing furnace, wherein the steel strip is continuously conveyed through a heating zone, a soaking zone, a primary cooling zone, and, occasionally, an overaging zone and a secondary cooling zone, and cooling of the steel strip, particularly in the primary cooling zone, is carried out by roll-cooling, in which the steel strip is brought into contact with and is turned around a rotatable roll which is continuously cooled by a cooling medium, characterized in that a roll comprising a roll shaft and a shrinkage-fitted roll sheath fixed to the roll shaft is used for roll cooling and, further, in that the cooling medium is circulated around the roll shaft through a coolingmedium circulating passage which is formed on at least the inner surface of the roll sheath or the outer surface of the roll shaft or both.

In accordance with the objects of the present invention, there is also provided a steel strip-cooling apparatus of a continuous annealing furnace comprising a heating zone, a soaking zone, a primary cooling zone, and, occasionally, an overaging zone and a secondary cooling zone, wherein said apparatus is used, particularly in the primary cooling zone, for cooling the steel strip which is brought into contact with and is turned around at least one cooling roll, characterized in that the roll comprises a roll shaft having roll ends, each of which is axially concentrical with respect to the roll shaft, a shrinkage-fitted roll sheath fixed to the roll shaft via an inner surface of the roll sheath and an outer surface of the roll shaft, a cooling medium circulating passage which is formed on at least the inner surface of the roll sheath or the outer surface of the roll shaft or both, and at least one cooling medium-supplying port and at least one cooling medium-withdrawal port, the ports being formed in the roll ends.

DESCRIPTION OF THE PREFERRED EMBODIMENTS

Figure 3:
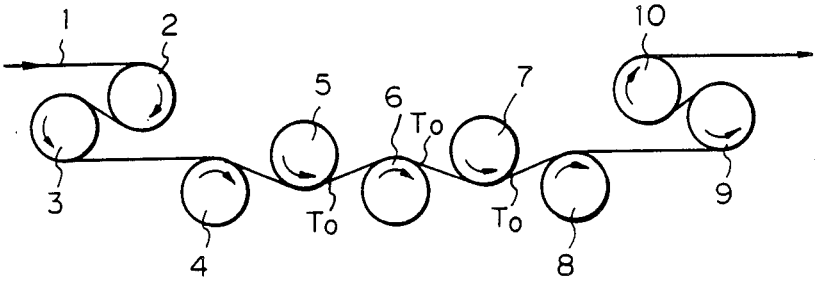
FIG. 3 illustrates an embodiment of the arrangement of rolls in the steel strip-cooling apparatus according to the present invention.

In FIG. 3, an example of the arrangement of the cooling rolls in a cooling zone, for example, a primary cooling zone of a continuous annealing furnace, is illustrated. A predetermined tension is imparted, by means of bridle rolls 2, 3, 9, and 10, to the steel strip 1, which is to be cooled. Reference numerals 4 and 8 denote deflecting rolls, and reference numerals 5, 6, and 7 denote cooling rolls according to the present invention. The number of cooling rolls 5, 6, and 7 is determined based on the capacity of the continuous annealing furnace and the like. The steel strip 1 is brought into contact with each of the cooling rolls 5, 6, and 7 at a predetermined winding angle or surface area which is determined by the thickness of the steel strip 1, the processing speed, the temperature of the cooling medium, and the like, and which is varied to attain a desired cooling rate.

Before describing the shrinkage-fitting of a roll sheath, the cooling of the steel strip 1 is described based on a present theory.

In the roll cooling of the steel strip 1, the temperature $T_0$ of the steel strip 1 at the exit side of the cooling rolls 5, 6, and 7 is expressed by the following formula (1):

$$T_0 = T_i - \frac{K \cdot \theta \cdot R(T_S - T_W)}{h \cdot V \cdot 60 \times 7850} \quad (1)$$

K in the formula (1) is the heat transmission coefficient between the steel strip 1 and the cooling medium (not shown) and is expressed by the following formula (2):

$$\frac{1}{K} = \frac{1}{k_1} + \frac{\theta}{2\pi}\left(\frac{d}{\lambda} + \frac{1}{k_2}\right) \quad (2)$$

The symbols in the formulas (1) and (2) indicate the following:

$T_0$: temperature of the steel strip 1 at the exit side (°C.)

$T_i$: temperature of the steel strip 1 at the entrance side (°C.)

$T_S$: average temperature of the steel strip 1 (°C.)

$T_W$: temperature of the cooling medium (°C.)

$\theta$: winding angle of the steel strip 1 around the cooling rolls 5, 6, and 7 (radian)

R: radius of the cooling rolls 5, 6, and 7 (m)

h: thickness of the steel strip 1 (m)

V: conveying speed of the steel strip 1 (m/min)

$k_1$: heat transfer efficiency between the steel strip 1 and the cooling rolls 5, 6, and 7 (kcal/m$^2$hr°C.)

$k_2$: heat transfer efficiency between the cooling rolls 5, 6, and 7 and the cooling medium (not shown) (kcal/m$^2$hr°C.)

$\lambda$: thermal conductivity of the material of the cooling rolls 5, 6, and 7 (kcal/mhr°C.)

d: thickness of a portion of the cooling rolls 5, 6, and 7 between the steel strip 1 and the cooling medium (not shown) (m)

Since the values of $T_i$, $\theta$, R, $T_W$, h, and V given in the formula (1) do not vary appreciably along the short width direction of the steel strip 1, the influence of $T_i$ and the like upon the steel strip temperature at the exit side is negligible. Therefore, in order to attain a uniform temperature distribution along the short width direction of the steel strip 1, it is essential to make the heat transmission coefficient K uniform along the short width direction.

The heat transfer efficiency ($k_1$) between the steel strip 1 and the cooling rolls 5, 6, and 7 is determined by the surface roughness of the steel strip 1, the surface roughness of the cooling rolls 5, 6, and 7, and the contact area pressure between the steel strip 1 and the surface of the cooling rolls 5, 6, and 7 and is expressed by the formula (3):

$$k_1 = Ap^n \quad (3),$$

in which A is a constant determined by the surface roughness of the steel strip 1 and the surface roughness of the cooling rolls 5, 6, and 7, p is the contact area pressure between the steel strip 1 and the surface of the cooling rolls 5, 6, and 7, and n is a constant.

According to an experiment carried out by the present inventors to determine the constants of the formula (3) regarding usual metal strips, including steel strips, formula (3) is considered as follows:

$$k_1 \neq 30000p^{0.5}$$

Since the surface roughness of the steel strip 1 and the surface roughness of the cooling rolls 5, 6, and 7 are deemed not to vary along the short width direction of the steel strip and the axial direction of the rolls, respectively, the heat transfer efficiency ($k_1$) between the steel strip 1 and the cooling rolls 5, 6, and 7 is determined essentially by the contact area pressure (p). The heat crown is the greatest factor which makes the contact area pressure (p) nonuniform along the short width direction of the steel strip 1. The heat crown is suppressed according to the present invention by shrinkage-fitting a roll sheath on the roll shaft (described more in detail hereinafter).

Figure 5:
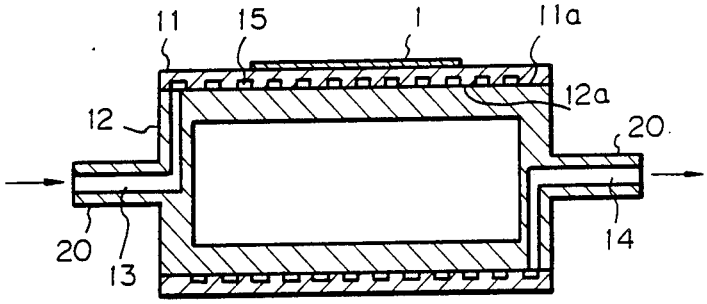
FIG. 5 is a longitudinal cross-sectional view of a roll according to an embodiment of the present invention.
Figure 6:
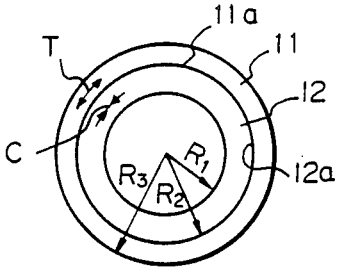
FIG. 6 is a schematic traversal cross-sectional view of a roll according to an embodiment of the present invention.

Referring to FIGS. 5 and 6, a roll sheath 11, hereinafter referred to as a sleeve 11, is fixed to the roll shaft 12 which is preferably hollow, by shrinkagefitting via the inner surface 11*a* there of and the outer surface 12*a* of the roll shaft 12. Reference numeral 20 denotes roll ends which are positioned axially concentrically with respect to the roll shaft 12 and which may be integral with the roll shaft 12 or may be rigidly connected to the roll shaft 12. The roll ends 20 are rotatably supported by bearings (not shown). In one of the roll ends 20, a cooling mediumsupplying port 13 is formed, and in the other roll end 20, a cooling medium-withdrawal port 14 is formed. A cooling medium-circulating passage 15 is spirally formed on the inner surface 11*a* of the sleeve 11 and is communicated with the cooling medium-supplying port 13 and the cooling medium-withdrawal port 14 so as to cool the sleeve 11 and the roll shaft 12 with the cooling medium. The cooling medium-circulating passage 15 is not limited to a spiral form but may be composed of a plurality of separated annular slots. For the shrinkage-fitting, the sleeve 11 is heated in a conventional manner and is then fitted on the roll shaft 12.

Figure 7:
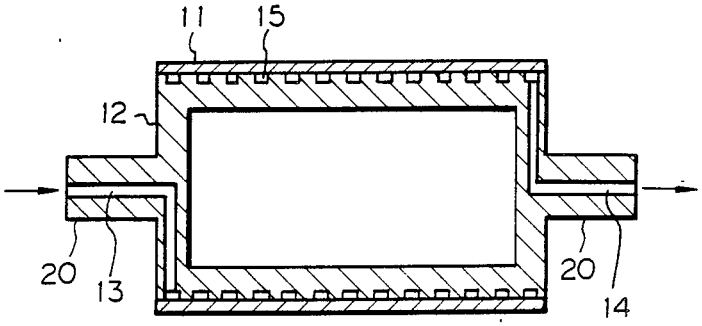
FIGS. 7 through 9 illustrate the rolls according to other embodiments of the present invention.
Figure 8:
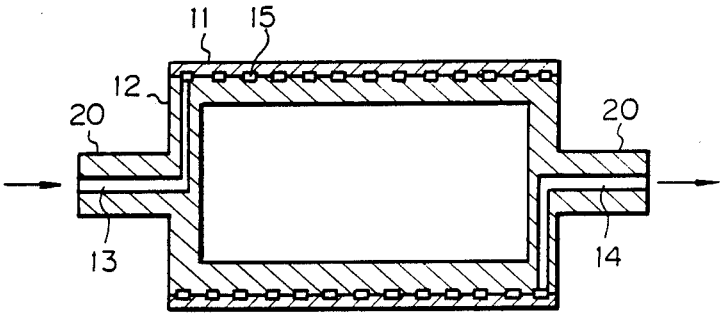
Figure 9:
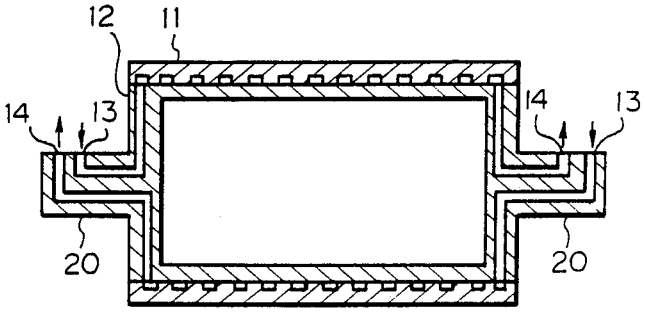

As is shown in FIG. 6, due to shrinkage-fitting, a circumferential tension stress T and a circumferential compression stress C are induced in the sleeve 11 and the roll shaft 12, respectively. The steel strip 1 (FIG. 5) is brought into contact with a major portion of the cooling roll as seen in an axial cross section of the cooling roll, and the temperature of the contact portion is elevated. The temperature of the roll shaft 12 is maintained at essentially the same temperature as that of the cooling medium. As a result of temperature elevation at the contact portion of the cooling rolls, thermal expansion of the sleeve 11 occurs, but the amount of heat crown resulting from thermal expansion of the sleeve is drastically reduced due to shrinkage-fitting, which induces tensional stress (T). That is, thermal expansion of the sleeve tends to decrease the tensional stress (T), but this stress remains in the sleeve 11, with the result that the amount of heat crown, if a heat crown is formed, is very small. Accordingly, the nonuniform contact between the steel strip 1 and the outer surface of the cooling roll (sleeve 11) can be drastically suppressed, and, thus, the cooling uniformity of the steel strip 1 along its short width direction can be drastically improved. In FIG. 7, the cooling medium-circulating passage 15 is formed on the outer surface 12*a* of the roll shaft 12. In FIG. 8, the cooling medium-circulating passage 15 is defined by matching groove halves formed on the outer surface 12*a* of the roll shaft 12 and the inner surface 11*a* of the sleeve 11, respectively. In FIG. 9, the cooling medium-supplying and -withdrawal ports 13 and 14, respectively, are formed in both of the roll ends 20 so as to reduce the temperature difference between the ends of the roll shaft as compared with those of the embodiments shown in FIGS. 7 and 8.

The cross-sectional shape of the cooling mediumcirculating passage 15 is square or rectangular in the above embodiments but may be round or oval.

Figure 4:
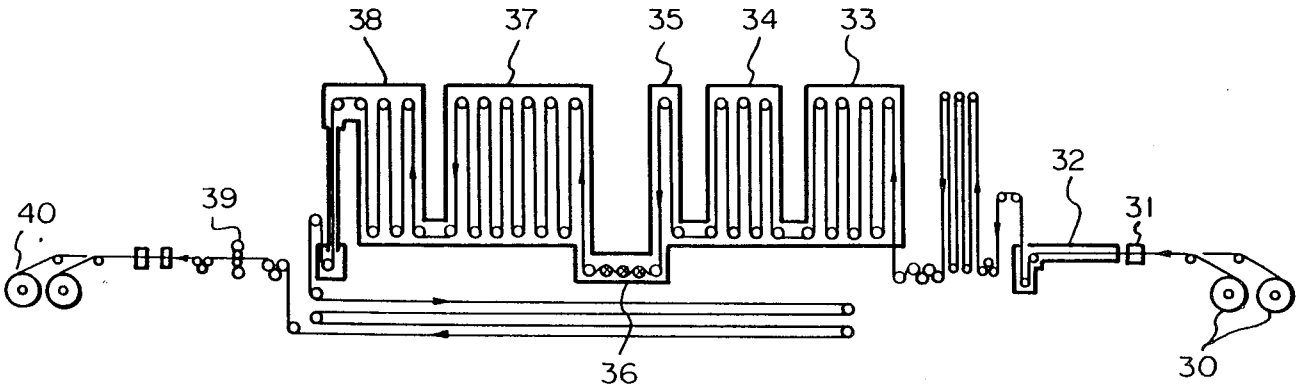
FIG. 4 is a schematic drawing of a known continuous annealing furnace in which the cooling method according to the present invention can be carried out.

In an embodiment of the method for cooling a steel strip in a continuous annealing furnace according to the present invention, as shown in FIG. 4, the steel strip 1 is conveyed continuously through a heating zone 33, a soaking zone 34, primary cooling zone 35 and 36, and, occasionally, an overaging zone 37 and a secondary cooling zone 38 of the continuous annealing furnace, and roll-cooling of the heated steel strip 1 is carried out particularly in the primary cooling zone 36. The roll cooling method according to the present invention can be carried out in the primary cooling zone 35 which is a slow cooling zone and/or the secondary cooling zone 38. Reference 31 denotes a known welder for welding steel strips wound around the pay off rolls, and reference 32 denotes a known electrolytic pickling device. Reference 39 and 40 denote known skin pass mill and tension reels, respectively. During roll-cooling, the conveyed steel strip 1 is brought into contact with at least one cooling roll and is turned around the at least one cooling roll along a predetermined conveying path, which is determined by the winding angle around cooling-roll(s), the at least one cooling roll comprising a roll shaft 12 (FIGS. 5 through 9) and a shrinkage-fitted sleeve 11 which is fixed to the roll shaft 12 via the inner surface 11*a* of the sleeve 11 and the outer surface 12*a* of the roll shaft 12, a cooling medium is supplied into the at least one cooling roll and is circulated around the roll shaft 12 through the cooling medium-circulating passage 15 which is formed on at least the inner surface 11*a* of the sleeve 11 or the outer surface 12*a* of the roll shaft 12 or both.

The shrinkage-fitting allowance, i.e., the difference between the inner diameter of the sleeve 11 (FIGS. 5 through 9) and the outer diameter of the roll shaft 12 before shrinkage-fitting, is such that in the light of the estimated temperature elevation of the cooling rolls the shrinkage-fitted amount is greater than zero during roll-cooling. A large shrinkage-fitting allowance is desirable. When the shrinkage-fitting allowance is restricted due to the strength of the roll material or the like, suppression of the heat crown can be satisfactorily attained even by such restricted shrinkage-fitting allowance. For example, if $R_1=650$ mm, $R_2=730$ mm, and $R_3=750$ mm in FIG. 6, a shrinkagefitting allowance of approximately 3 mm (in diameter) is remarkably effective for suppressing the heat crown against a temperature elevation of up to approximately 200° C. in terms of the sleeve temperature.

An example of the determining of the shrinkagefitting allowance is described in detail.

The quantity of heat (Q) passing through a unit surface area of a cooling roll is determined by the following formula (4):

$$Q = \frac{\theta}{2\pi} k(T_s - T_w) \quad (4)$$

The average temperature $\overline{T}_R$ of the sleeve is expressed by the following formula (5):

$$\overline{T}_R = \frac{T_{Rs} + T_{Rw}}{2} = Q\left(\frac{d}{2\lambda} + \frac{1}{k_2}\right) + T_w, \quad (5)$$

wherein $T_{Rs}$ is the temperature of a portion of the cooling roll (sleeve) in contact with the steel strip, and $T_{Rw}$ is the temperature of a portion of the cooling roll (roll shaft) in contact with the cooling medium. Since the temperature of the roll shaft can be deemed equal to the temperature of the cooling medium, the temperature elevation $\Delta T_R$ of the sleeve relative to the roll shaft is expressed by:

$$\Delta T_R = \overline{T}_R - T_w = Q\left(\frac{d}{2\lambda} + \frac{1}{k_2}\right). \quad (6)$$

The shrinkage-fitting allowance in the radius ($\Delta R$) must be such that upon temperature elevation $\Delta T_R$ the sleeve is not separated from the roll shaft due to thermal expansion of the sleeve. That is, the following formula:

$$\Delta R/R \geqq \alpha \cdot \Delta T_R \quad (7)$$

must be satisfied. The linear thermal expansion coefficient is denoted by "$\alpha$" in formula (7).

Incidentally, as long as the shrinkage-fitting allowance in the radius ($\Delta R$) satisfies the formula (7), a considerably greater shrinkage-fitting allowance ($\Delta R$) than that defined by formula (7) is meaningless because the cooling effects remain unchanged, and, further because the stress induced in the sleeve due to shrinkage-fitting becomes exceedingly great. Practically, the shrinkage-fitting allowance ($\Delta R$) is greater than $\alpha \cdot \Delta T_R \cdot R$ by the amount of the machining accuracy of the cooling roll.

An example of the calculating of the shrinkagefitting allowance ($\Delta R$) is as follows:

$k_1 = 2{,}000$ kcal/$m^2$·hr·°C.
$k_2 = 5{,}000$ kcal/$m^2$·hr·°C.
$\lambda = 46$ kcal/$m$·hr·hr·°C.
$\theta = 100$ degrees
$T_s = 600°$ C.
$T_w = 40°$ C.
$\alpha = 1.0 \times 10^{-5}$/°C.

The heat transmission coefficient K according to formula (2) is as follows using the above parameters:

$$K = 1{,}480 \text{ kcal}/m^2\cdot\text{hr}\cdot°\text{C}.$$

The quantity of heat (Q) according to formula (4) is then as follows:

$$Q = 230{,}000 \text{ kcal}/m^2\cdot\text{hr}$$

The temperature elevation ($\Delta T_R$) according to formula (6) is then as follows:

$$\Delta T_R = 136° \text{ C}.$$

The shrinkage-fitting allowance ($\Delta R$) in the radius is finally obtained according to formula (7) as $$\Delta R \geqq 0.72 \text{ mm}.$$

Figure 1:
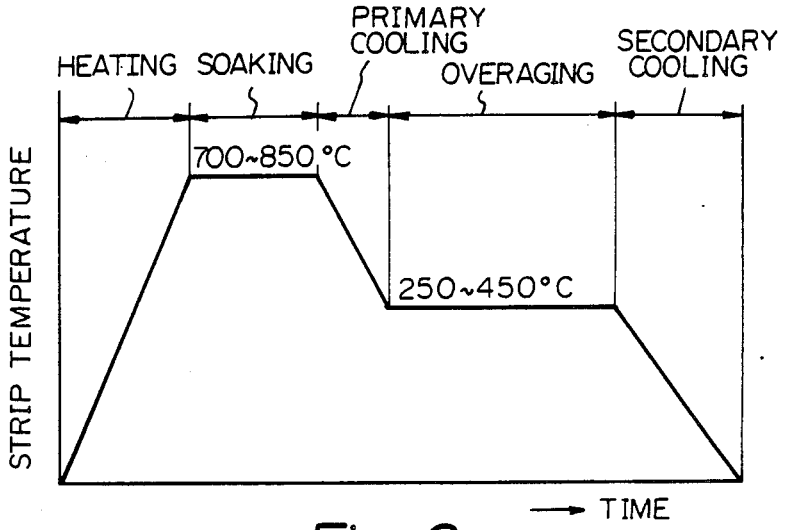
FIG. 1 illustrates a continuous annealing heat cycle in which a cold-rolled steel strip is primary-cooled by gas-jet cooling.
Figure 2:
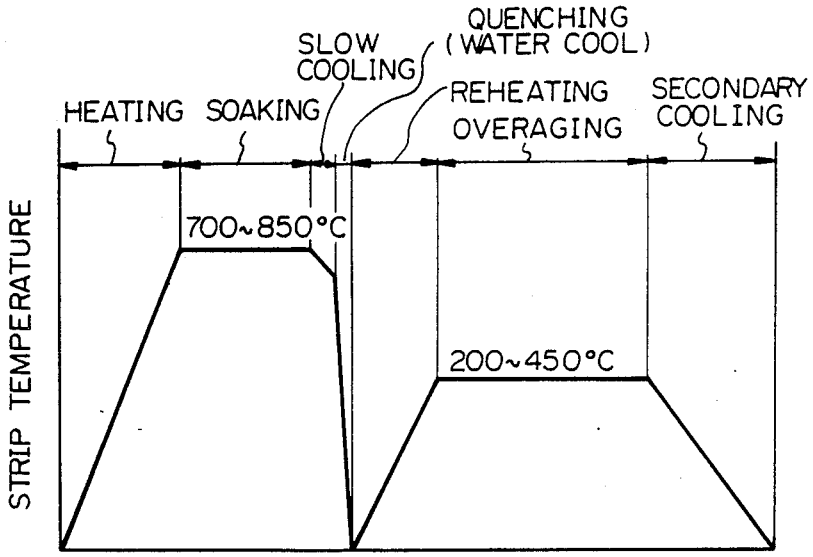
FIG. 2 illustrates a continuous annealing heat cycle in which a cold-rolled steel strip is primary-cooled by water cooling.

As is described hereinabove, since the heat crown can be effectively suppressed, uniform cooling of a steel strip along the short width direction can be effectively attained. This makes it possible to employ the roll cooling method for cooling in any cooling zone of the continuous annealing furnace, particularly for the primary cooling shown in FIG. 1 and the slow cooling shown in FIGS. 2 and 4, as well as the secondary cooling shown in FIGS. 1 and 2. In the primary cooling, the temperature can be lowered from a temperature of from 600° to 850° C. down to 470° C. at the highest.

In addition, according to the present invention, the cooling rate of the steel strip can be considerably greater than that achieved by gas-jet cooling. The cooling rate according to the present invention is preferably from 50° to 300° C., more preferably from 70° to 200° C., e.g. approximately 100° C., per second, while the cooling rate of gas-jet cooling is, for example, from 10° C./sec to 30° C./sec. It is expected, due to such a high cooling rate, that the mechanical properties of continuously annealed steel strips can be enhanced. A variance in the qualities of steel strips along the short width direction can be reduced due to a uniform cooling rate along the short width direction. No oxidation of the steel strips occurs during the rollcooling according to the present invention, and, therefore, the annealed steel strips need not be pickled, which is advantageous from an economical point of view.

The present invention is described by way of examples.

Figure 10:
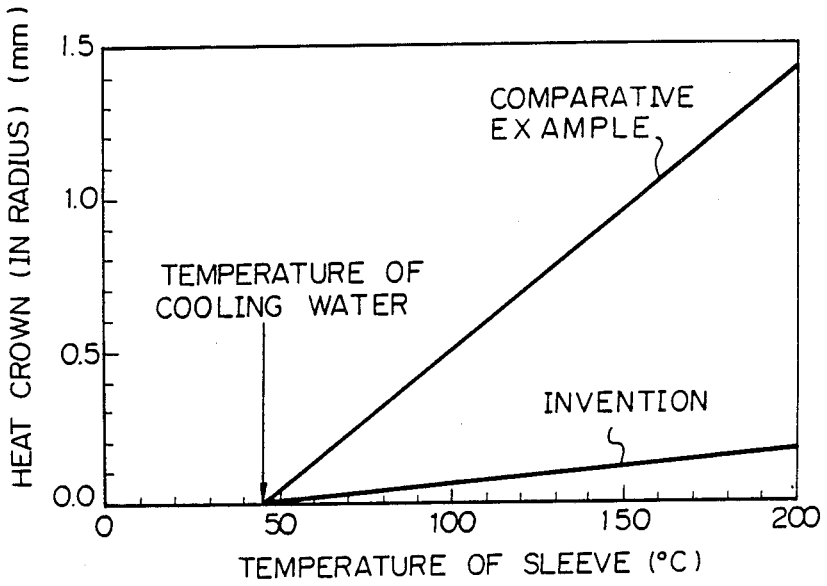
FIG. 10 is a graph indicating the amount of heat crown in an example according to the present invention and in a comparative example.

Referring to FIG. 10, the heat crown in the radius (mm) is shown as a function of the sleeve temperature (°C.) with regard to both the present invention (shrinkage-fitted cooling rolls) and the comparative example (monolithic cooling rolls). These rolls were used for the primary cooling of steel strips in a continuous annealing furnace. As is apparent from FIG. 10, the heat crown is suppressed according to the present invention.

Figure 11:
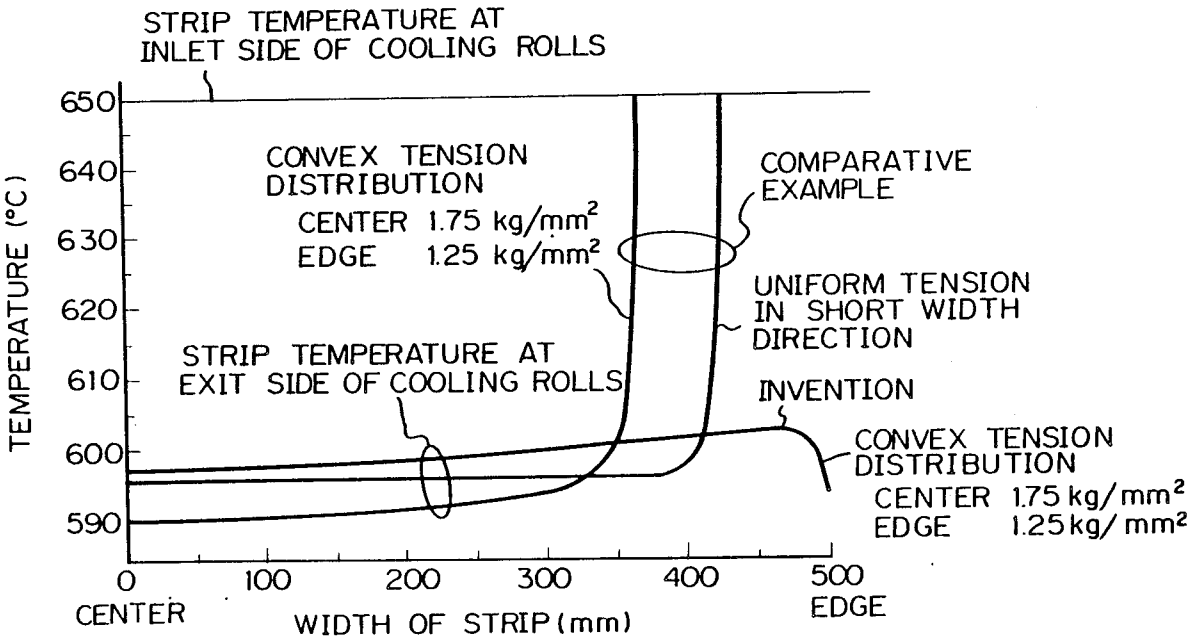
FIG. 11 is a graph indicating the steel strip temperature distribution at the exit side of cooling rolls in an example according to the present invention and in a comparative example.

Referring to FIG. 11, the temperature of a 1,000 mm-wide steel strip in the short width direction is shown with regard to both the present invention (the shrinkage-fitted cooling rolls) and the comparative example (the monolithic cooling rolls). As is apparent from FIG. 10, the temperature distribution of a steel strip in the short width direction is uniform at the entrance side of the cooling rolls but is nonuniform in the comparative example due to ineffective cooling at the edges of the steel strip. The temperature distribution of a steel strip in the short width direction at the exit side of the cooling rolls is drastically improved according to the present invention.

I claim:

1. A method for cooling a steel strip in a continuous annealing furnace, comprising the steps of:

continuously conveying a steel strip through a heating zone, a soaking zone, and a primary cooling zone of the continuous annealing furnace; and carrying out a primary zone roll-cooling of the steel strip;

said roll-cooling step further comprising the steps of:

bringing said conveyed steel strip into contact with at least one cooling roll and turning said steel strip around said at least one cooling roll along a predetermined conveying path of contact with said at least one cooling roll, while imparting tension to the strip, said at least one cooling roll comprising a roll shaft and a shrinkage-fitted roll sheath forming a cooling surface fixed to said roll shaft via an inner surface of the roll sheath and an outer surface of the roll shaft;

retaining uniform contact of said strip with said cooling surface across the short width direction of said strip, by said shrinkage-fitted roll sheath suppressing heat crown of said cooling surface thereby uniformly cooling said strip in contact with said cooling surface across said short width direction of said strip; and circulating said cooling medium around said roll shaft through a cooling medium-circulating passage which is formed on at least the inner surface of said roll sheath or the outer surface of said roll shaft or both.

2. A method according to claim 1, wherein the temperature is lowered from a temperature of from 600° C. to 850° C. down to 470° C. at the highest in said primary cooling zone.

3. A method according to claim 1 or 2, wherein said cooling medium is water.

4. A method for cooling a steel strip in a continuous annealing furnace, comprising the steps of:

continuously conveying a steel strip through a heating zone, a soaking zone, a primary cooling zone, and, an overaging zone and a secondary cooling zone of the continuous annealing furnace; and carrying out roll-cooling of the steel strip in the secondary cooling zone;

said roll-cooling step further comprising the steps of:

bringing said conveyed steel strip into contact with at least one cooling roll and turning said steel strip around said at least one cooling roll along a predetermined conveying path of contact with said at least one cooling roll, while imparting tension to the strip, said at least one cooling roll comprising a roll shaft and a shrinkage-fitted roll sheath forming a cooling surface fixed to said roll shaft via an inner surface of the roll sheath and an outer surface of the roll shaft;

retaining uniform contact of said strip with said cooling surface across the short width direction of said strip, by said shrinkage-fitted roll sheath suppressing heat crown of said cooling surface thereby uniformly cooling said strip in contact with said cooling surface across said short width direction of said strip; and circulating said cooling medium around said roll shaft through a cooling medium-circulating passage which is formed on at least the inner surface of said roll sheath or the outer surface of said roll shaft or both.

5. A method according to claim 4, wherein the temperature is lowered from a temperature of from 250° to 450° C. down to room temperature in said secondary cooling zone.

6. A method according to claim 4 or 5, wherein said cooling medium is water.

7. A method according to claim 4 further comprising:

carrying out primary zone roll-cooling of the steel strip;

said primary zone roll-cooling step further comprising the steps of:

bringing said conveyed steel strip into contact with at least one primary zone cooling roll and turning said steel strip around said at least one cooling roll along a predetermined conveying path of contact with said at least one primary zone cooling roll, while imparting tension to the strip, said at least one primary zone cooling roll comprising a roll shaft and a shrinkage-fitted roll sheath forming a cooling surface fixed to said roll shaft via an inner surface of the roll sheath and an outer surface of the roll shaft;

retaining uniform contact of said strip with said cooling surface across the short width direction of said strip, by said shrinkage-fitted roll sheath suppressing heat crown of said cooling surface thereby uniformly cooling said strip in contact with said cooling surface across said short width direction of said strip; and circulating said cooling medium around said roll shaft through a cooling medium-circulating passage which is formed on at least the inner surface of said roll sheath or the outer surface of said roll shaft or both.

* * * * *